US005722583A

United States Patent [19]

Focke et al.

[11] Patent Number: 5,722,583

[45] Date of Patent: Mar. 3, 1998

[54] CARDBOARD PACKAGING

[75] Inventors: Heinz Focke, Verden; Henry Buse, Visselhövede, both of Germany

[73] Assignee: Focke & Co. (GmbH & Co.), Verden, Germany

[21] Appl. No.: 690,231

[22] Filed: Jul. 19, 1996

[30] Foreign Application Priority Data

Jul. 26, 1995 [DE] Germany ..... 195 26 988.8

[51] Int. Cl.[6] ..... B65D 5/54

[52] U.S. Cl. ..... 229/120.011; 229/120.17

[58] Field of Search ..... 229/120.011, 120.17, 229/127

[56] References Cited

U.S. PATENT DOCUMENTS

| | | | |
|---|---|---|---|
| 2,758,777 | 8/1956 | Dixon | 229/120.17 |
| 3,092,301 | 6/1963 | Selle | 229/120.011 |
| 3,677,458 | 7/1972 | Gosling . | |
| 3,743,167 | 7/1973 | Russell . | |
| 3,744,700 | 7/1973 | Stegmann . | |
| 4,826,016 | 5/1989 | Foster . | |
| 4,913,291 | 4/1990 | Schuster . | |
| 5,102,037 | 4/1992 | Bryan | 229/120.011 |
| 5,129,575 | 7/1992 | Bryan | 229/120.011 |
| 5,299,733 | 4/1994 | Werth | 229/120.011 |

FOREIGN PATENT DOCUMENTS

| | | | |
|---|---|---|---|
| 542449 | 5/1993 | European Pat. Off. | 229/120.011 |
| 1890573 | 4/1964 | Germany . | |
| 1905941 | 12/1964 | Germany . | |
| 4200921 | 7/1993 | Germany . | |
| 0266321 | 5/1988 | Italy . | |
| 0647565 | 4/1995 | Netherlands . | |
| 406059 | 7/1966 | Switzerland . | |
| 739899 | 11/1955 | United Kingdom . | |
| 1461539 | 1/1977 | United Kingdom . | |
| 1490896 | 11/1977 | United Kingdom . | |
| 9007454 | 7/1990 | WIPO . | |

*Primary Examiner*—Gary E. Elkins
*Attorney, Agent, or Firm*—Abelman, Frayne & Schwab

[57] ABSTRACT

A cardboard package is disclosed which comprises two subsidiary boxes (10, 11) which are initially joined to one another at a central fold line. The subsidiary boxes can be separated in the region of a central folding edge (14) at the central fold line because of weaknesses in the material (e.g. perforations), so that two self-contained subsidiary boxes, enclosed on all sides, are formed. The package is formed from a single blank. The blank is of a uniform width throughout—with the exception of the lid (29, 30). Pairs of side flaps (32, 33, 34, 35) are positioned on opposed sides of the blank to form the side walls (23, 24, 25, 26), with the side flaps in the assembled package being positioned in one plane without overlap and are held together by base flaps (36, 37).

7 Claims, 4 Drawing Sheets

CARDBOARD PACKAGING

DESCRIPTION

Figure 1:
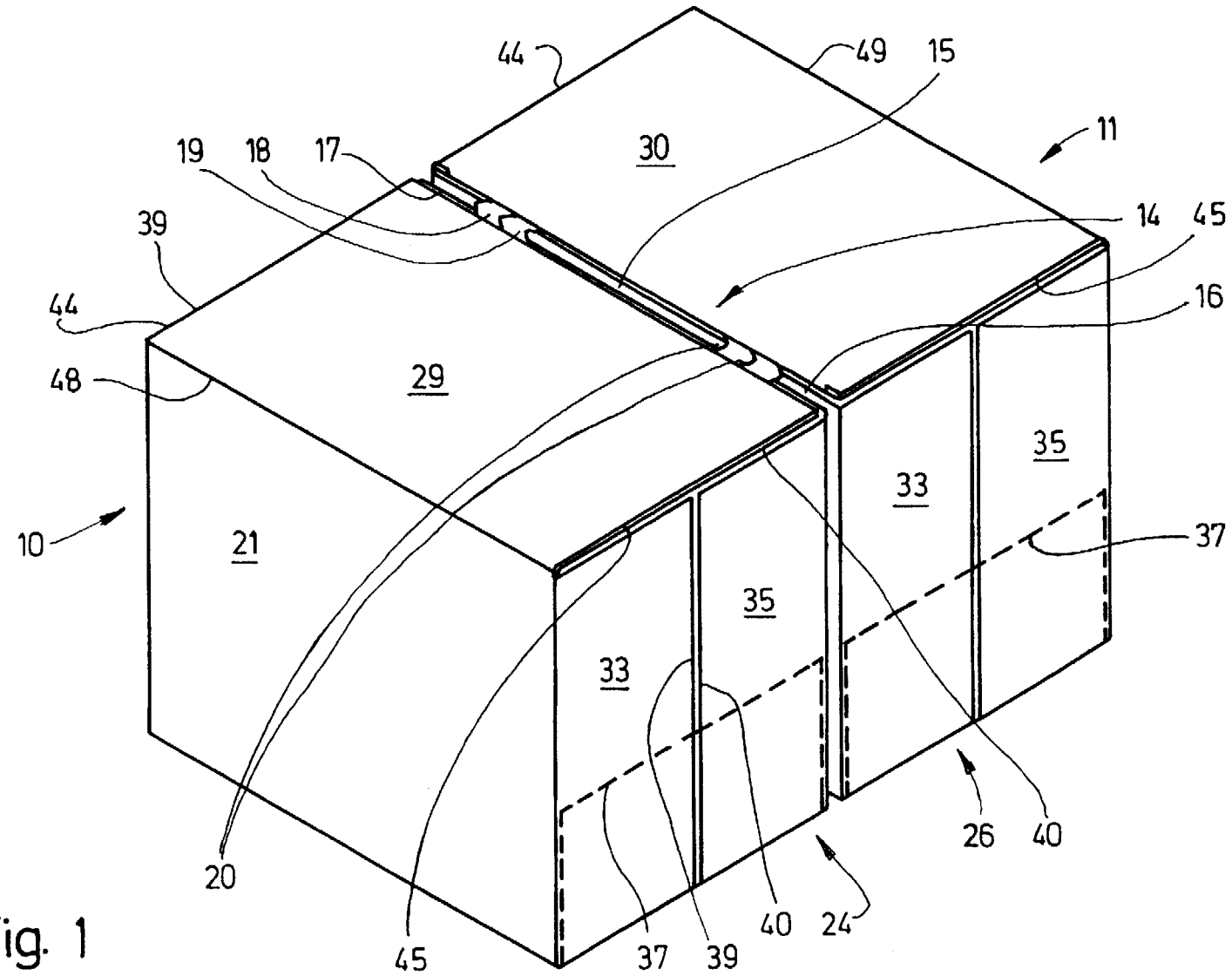

The invention relates to a box made of stiff, foldable packaging material, especially cardboard. The box comprises two separable subsidiary boxes, which are folded out of a single blank with a base wall, front wall, back wall, and side walls for each subsidiary box, in such a way that upright front walls adjoin each other before being separated. The upright front walls are connected to one another in the region of an upper folding edge, which is provided with weaknesses in the material. The side walls are formed of folding flaps which are joined to the base, front and back walls.

Boxes consisting of an originally one-piece blank with two separable subsidiary boxes are, for instance, known for containing cigarette boxes, i.e. in so-called cigarette cartons. This "double pack" for cigarettes consists of thin cardboard.

This invention is concerned with the design of boxes of quite large volume to take individually packed items, e.g. bottles, small packages etc. The box can also be divided, consisting as it does of two separable subsidiary boxes joined to one another, each as a self-contained unit. The subsidiary boxes can be separated in the region of a common folding edge. Preferably the folding edge is in the centre and is designed with weaknesses in the material, e.g. perforations, selected punched-out lines with residual connections or the like.

The object underlying the invention is so to design a box of this kind or the blank for making the box, such that relatively little material is necessary to form a box closed on all sides or subsidiary boxes designed in this way.

In fulfilment of this object, the box according to the invention is characterized in that side flaps connected to the front wall and the back wall are so dimensioned that in the folded position they correspond to approximately half the width of a side wall and in that these side flaps are connected, by preference on the inside, in a region facing the base wall by a base flap connected with the base wall, in the assembled position of this flap, through gluing, sealing, stapling or the like.

The box according to the invention consists essentially of relatively thick cardboard material, especially of corrugated cardboard. The blank for the manufacture of the "double pack" according to the invention is of simple design, namely an elongated, essentially square shape which—apart from regions attached to the ends for a lid for each subsidiary box—have the same width throughout.

The side walls of the two subsidiary boxes consist of folding flaps, which are attached to both sides of the front and back walls as well as to the base walls. The width of the side flaps arranged on the front wall and the back wall (measured at right angles to the longitudinal extension of the blank) corresponds to approximately half the length of the base wall (measured lengthwise along the blank). Thus, the two side flaps on each side of a subsidiary box form a complete side wall, with the side flaps being positioned in a common plane without overlap. The free outside edges of the side flaps can push against one another or leave a narrow, upright gap free. To complete the side walls a base flap is folded on the inner side against each of the two side flaps and preferably, glued to the side flaps. Thus the side walls are single-layered in the upper region and double-layered in the lower region.

Moreover, a lid is designed in a special way for each subsidiary box, and is of such dimensions that the lid terminates flush with the side walls. An insertion tab connected to the lid is designed accordingly.

Figure 2:
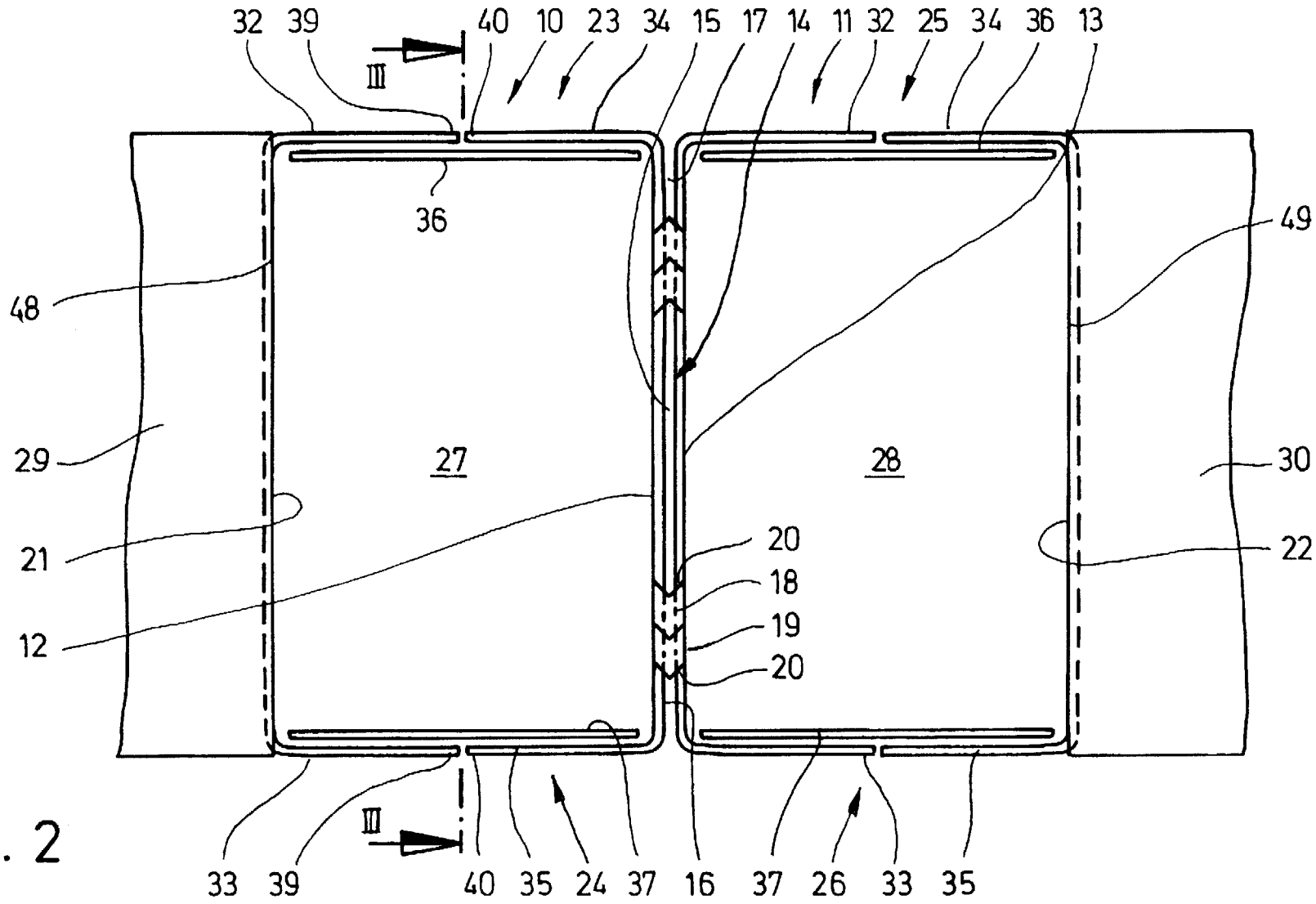
Figure 3:
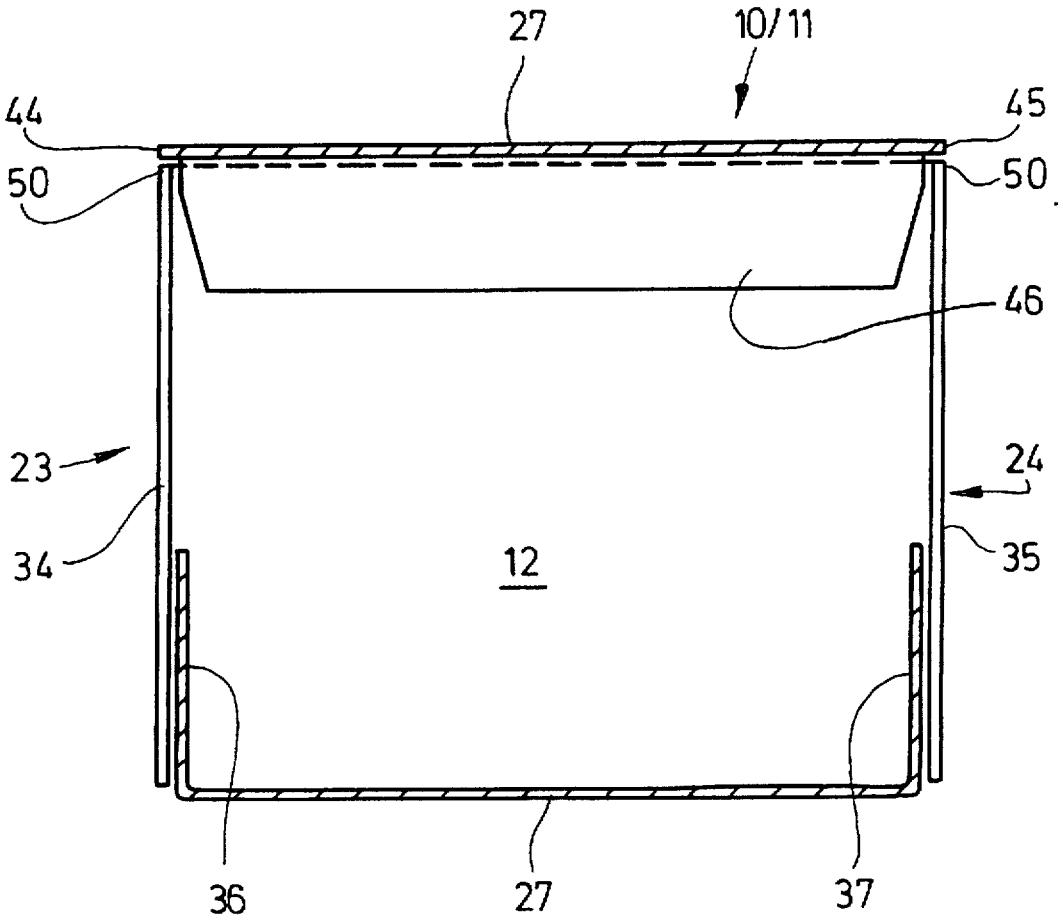
Figure 4:
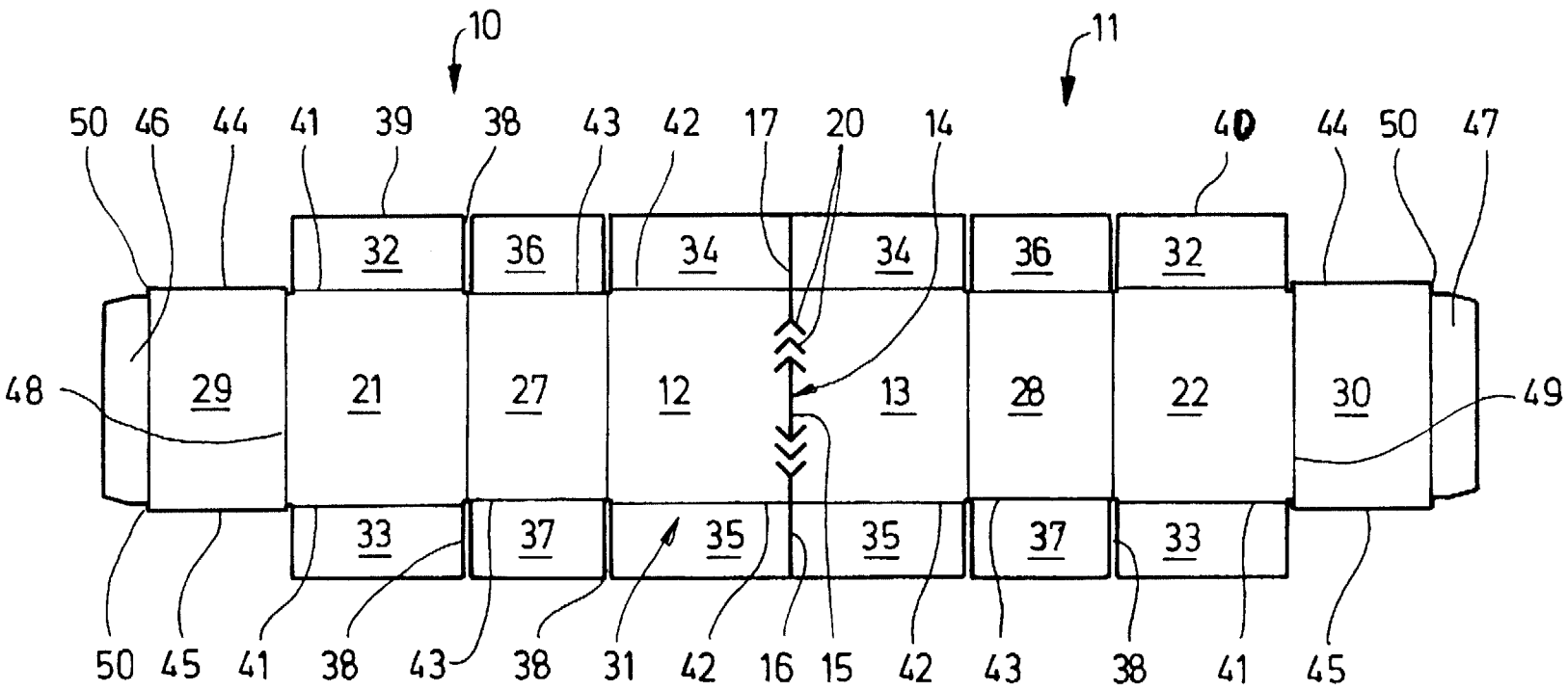

Further details of the box are explained below in greater detail with the aid of the embodiment, given by way of example and depicted in the drawings. These show:

FIG. 1 a box with two subsidiary boxes, in perspective view,

FIG. 2 the box according to FIG. 1 in plan view with the lid open,

FIG. 3 a cross-section through a subsidiary box in the cutting plane III—III of FIG. 2, FIG. 4 a blank for making a box according to FIG. 1, in its extended state.

The box shown in FIG. 1 consists, before being divided, of two subsidiary boxes 10, 11, connected to one another. These adjoin one another in the region of walls facing one another, e.g. in the region of front walls 12, 13. The relevant walls—front walls 12, 13—are connected to one another along a common upper transverse folding edge 14 and capable of being separated. The folding edge 14 is so designed that easy manual separation of the subsidiary boxes 10, 11 from one another is possible, e.g. through perforation of the folding edge 14. In the present case, the folding edge 14 is defined by three continuous punched-out lines 15, 16, 17. These are each interrupted by two pairs of residual connections 18, 19, which for their part are each bordered by V-shaped perforations.

Each subsidiary box 10, 11 is—after being separated in the region of the folding edge 14—a self-contained box, enclosed on all sides. Hence the subsidiary boxes 10, 11 consist of the already mentioned front walls 12, 13, of back walls 21, 22, of side walls 23, 24 or 25, 26, of base walls 27, 28 and of a lid each 29, 30. The subsidiary boxes 10, 11 designed in this way are of exactly the same size. The folding edge 14 is accordingly also positioned in the centre of the blank (FIG. 4).

The one-piece blank for making such a "double pack", consisting of two subsidiary boxes 10, 11, is, as FIG. 4 shows, an elongated rectangular shape of the same width throughout—with the exception of the two regions set at both ends for the lids 29, 30. The side walls 23, 24 or 25, 26 are formed by folding flaps which are positioned on both sides of a middle strip 31 running right through to form front wall 12, 13, back wall 21, 22 and base wall 27, 28. The folding flaps are allocated to the respective walls of the subsidiary boxes 10, 11. Thus side flaps 32, 33 or 34, 35 are arranged in each case on both sides of the front walls 12, 13 on the one hand and of the back walls 21, 22 on the other hand. In the region of the base walls 27, 28 there are base flaps 36, 37. The previously mentioned folding flaps are each designed as rectangular with dimensions corresponding to the length—measured lengthwise along the blank—of the allocated box walls. Neighbouring folding flaps are divided from one another by punched-out lines 38.

The width of the side flaps 32..35 (at right angles to the longitudinal extension of the blank) determines the width of the whole blank. The sides flaps 32..35 serve together to form the side walls 23..26. For this purpose, the side flaps 32..35 are folded in the plane of the side walls 23..26. The side flaps 32..35 are so designed that they lie in a common plane without any reciprocal overlap. In the finished box, upright rim edges 39, 40 push against one another in the plane of the side walls 23..26 or form, as shown in FIG. 1, a narrow upright gap.

From this function arise the dimensions of the side flaps 32..35, the width of which (at right angles to the blank)

corresponds to approximately half the length (lengthwise along the blank) of the base wall 27.

The base flap 36, 37 connected to the base wall 27, 28, is likewise part of the side wall 23..26. For this purpose the base flap 36, 37 is folded into an upright position and lies inside, i.e. inside the box, adjoining the side flaps 32, 33 or 34, 35. To form a rigid strong side wall 23..26, the base flap 36,. 37 is connected permanently, by gluing, stapling or the like, with the corresponding side flaps 32..35.

The areas for forming the walls of the subsidiary boxes 10, 11 are limited inside the blank by embossed folding lines. Longitudinal folding lines 41, 42, between the front walls 12, 13 as well as back walls 21, 22 on the one hand and the corresponding side flaps 32..35 on the other hand, are displaced outwards in relation to longitudinal folding lines 43 between base wall 27, 28 on the one hand and base flap 36, 37 on the other hand. The longitudinal folding lines 43 are displaced inwards, so that the base wall 27, 28 has a smaller width (transverse direction of the blank) than the adjoining front walls 12, 13 and back walls 21, 22. Through this displacement of the longitudinal folding lines 41, 42, 43, allowance is made for the fact that in the folded box, the base flap 36, 37 is positioned off-set inwards in relation to the side flaps 32..35.

The lid 29, 30 is designed in a special way. It is attached at both ends of the blank as an extension without side folding flaps. The width of the lid 29, 30 (at right angles to the blank) is greater than the width of the front walls 12, 13 and back walls 21, 22 running against the lid 29, 30. Because of this, the lid 29 sits flush on each of the subsidiary boxes 10, 11 (FIG. 3). A side rim 44, 45 of the lid terminates flush with the outside contour of the subsidiary box 10, 11, namely the side wall 23..26.

On a free transverse edge of the lid 29, 30, an insertion tab 46, 47 is attached. In the assembled closed subsidiary box 10, 11, the tab is inserted into the box in contact with the inside of each front wall 12, 13. The lid 29, 30 forms a hinge 48, 49 in relation to the back wall 21, 22. When the box is not divided, the insertion tabs 46, 47 of the two subsidiary boxes 10, 11 face one another in the closed position, being fixed on the neighbouring front walls 12, 13 by being inserted.

The width of the insertion tabs 46, 47 (transverse to the direction of the blank) is smaller than the width of the lid 29, 30. Between insertion tab 46, 47 on the one hand and lid 29, 30 on the other hand, a step 50 is formed on both sides. This makes it possible for the insertion tab to be slotted in the closed position (FIG. 3) without any squeezing.

We claim:

1. A box made of stiff, foldable packaging material which comprises two separable subsidiary boxes (10, 11), which are folded out of a common one-piece blank, each of said subsidiary boxes including a from wall (12, 13), a back wall (21, 22), a base wall (27, 28), and side walls (23, 24, 25, 26), with the front wall (12) of one of said subsidiary boxes (10) and the from wall (13) of the other of said subsidiary boxes (11) adjoining one another before being separated, and connected to one another along an upper folding edge (14), means for weakening the material along said fold line to permit the separation of said subsidiary boxes, each of said side walls (23, 24, 25, 26), formed of pairs of individual folding tabs (33–35, 32–34), one of said pairs of said folding flaps joined to the front wall (12), back wall (21), and base wall (27) of one of said subsidiary boxes (10) and the other of said pairs of folding flaps joined to the from wall (13), back wall (22), and base wall (28) of the other of said subsidiary boxes (11), characterized in that: said side flaps (32 to 35) connected to said front walls (12, 13) and back walls (21, 22), are dimensioned such that, in the folded position and forming the finished package, the width of said side flaps (32 to 35) corresponds to approximately half the width of the associated side walls (23 to 26), the respective base walls (27, 28) of both of said subsidiary boxes (10, 11) are connected laterally to base flaps (36, 37) folded into the plane of the respective adjacent side wall (23 to 26), and the side flap (32 to 35) of both of said subsidiary boxes (10, 11) are connected to the base flaps (26, 27) in the areas facing the base walls (27, 28).

2. A box according to claim 1, characterized in that a lid (29, 30) for each of said subsidiary boxes is attached to opposed ends of the blank, connected to its respective back wall (21, 22), each lid being opposite the base wall (27) of each subsidiary box (10, 11), the width of each lid (29, 30) transverse to the longitudinal extension of the blank being greater than the width of the adjacent back wall (21, 22) such that each lid (29, 30) in the closed position terminates externally flush with the side walls (23 to 26).

3. A box according to claim 2, characterized in that an insertion tab (46, 47) is connected to an edge of each lid (29, 30) opposite the back wall (21, 22), and the width of each insertion tab (46, 47) transverse to the blank is slightly less than the width of the associated lid (29, 30).

4. A box according to claim 1, characterized in that the base wall (27, 28) of each subsidiary box (10, 11) is smaller in width, transverse to the longitudinal extension of the blank, that the from wall (12, 13), and the back wall (21, 22) correspond to the thickness of the material of the side flaps (32 to 35) for forming a respective external part of the side walls (23 to 26).

5. A box according to claim 1, characterized as being made of cardboard.

6. A box according to claim 1, characterized in that the base flaps (36, 37) are connected to the inner side of the side flaps (32 to 35).

7. A box according to claim 1, characterized in that the base flaps (36, 37) are connected to the side flaps (32 to 35) by gluing, sealing or stapling.

* * * * *